US007744063B2

(12) United States Patent
Jones

(10) Patent No.: US 7,744,063 B2
(45) Date of Patent: Jun. 29, 2010

(54) SAFETY DEVICE

(75) Inventor: Karl Jones, Wiltshire (GB)

(73) Assignee: Latchways PLC, Devizes, Wiltshire (GB)

( * ) Notice: Subject to any disclaimer, the term of this patent is extended or adjusted under 35 U.S.C. 154(b) by 0 days.

(21) Appl. No.: 12/093,937

(22) PCT Filed: Nov. 2, 2006

(86) PCT No.: PCT/GB2006/004098

§ 371 (c)(1),
(2), (4) Date: Aug. 13, 2008

(87) PCT Pub. No.: WO2007/057636

PCT Pub. Date: May 24, 2007

(65) Prior Publication Data

US 2009/0032785 A1 Feb. 5, 2009

(51) Int. Cl.
*B66D 3/04* (2006.01)

(52) U.S. Cl. ..... 254/392; 254/410

(58) Field of Classification Search ..... 254/391, 254/392, 410; 182/3, 231, 5
See application file for complete search history.

(56) References Cited

U.S. PATENT DOCUMENTS

| | | | | |
|---|---|---|---|---|
| 3,807,696 | A * | 4/1974 | Brda | 254/391 |
| 4,003,550 | A * | 1/1977 | Brodin | 182/42 |
| 4,173,332 | A * | 11/1979 | DuLondel | 254/391 |
| 4,452,430 | A * | 6/1984 | Kankkunen | 254/391 |
| 5,722,612 | A * | 3/1998 | Feathers | 242/381.5 |
| 6,279,682 | B1 * | 8/2001 | Feathers | 182/239 |
| 6,810,997 | B2 * | 11/2004 | Schreiber et al. | 182/238 |
| 7,377,487 | B2 * | 5/2008 | Otten | 254/392 |
| 2002/0179372 | A1 * | 12/2002 | Schreiber et al. | 182/238 |
| 2005/0145435 | A1 | 7/2005 | Choate | |
| 2005/0269153 | A1 * | 12/2005 | Casebolt | 182/3 |
| 2007/0215410 | A1 * | 9/2007 | Ecker | 182/192 |
| 2009/0084883 | A1 * | 4/2009 | Casebolt et al. | 242/389 |

FOREIGN PATENT DOCUMENTS

| | | | |
|---|---|---|---|
| GB | 2255067 | A * | 10/1992 |
| WO | 95/19203 | A | 7/1995 |
| WO | 01/46601 | A | 6/2001 |

OTHER PUBLICATIONS

International Search Report, ISA/EPO, Feb. 19, 2007.

* cited by examiner

*Primary Examiner*—Emmanuel M Marcelo
(74) *Attorney, Agent, or Firm*—John K. Fitzgerald; Fulwider Patton LLP

(57) ABSTRACT

A safety device for a fall arrest system comprises: a body, attachment means for attaching the safety device to a support structure, a drum mounted for rotation relative to the body, a safety line wound on the drum, a speed sensitive clutch connected to the drum, and a linear energy absorber connecting the body to the attachment means, in which the speed sensitive clutch is adapted to respond to rotation of the drum relative to the body in a direction tending to unwind the safety line from the drum and above a predetermined speed by locking the drum against further rotation in said direction relative to the body, and the linear energy absorber is adapted to respond, when the speed sensitive clutch has locked the drum, to an applied load along the safety line greater than a threshold value by deploying and absorbing energy so that the attachment means moves away from the body.

11 Claims, 3 Drawing Sheets

SAFETY DEVICE

RELATED APPLICATIONS

This is a U.S. national phase application of PCT/GB2006/004098, filed Nov. 2, 2006, which claims priority to United Kingdom Application No. 0614089.1, filed Jul. 14, 2006 and United Kingdom Application No. 0523254.1, filed Nov. 15, 2005.

This invention relates to an improved safety device and particularly to an improved safety device for use in a fall arrest system.

Fall arrest systems are used to prevent personnel working at height from suffering injury or death due to falls. Fall arrest systems are also commonly referred to as height safety systems or fall prevention systems.

One common form of fall arrest system employs a safety block 1, as shown in FIG. 1. The safety block 1 comprises a safety line or cable 2 wound around a drum 3 mounted for rotation within a casing 4. The casing 4 includes attachment means 5 for attaching the safety block to a fixed support structure (not shown). The drum 3 is biassed by a tensioning and re-spooling device 6 in a direction of rotation acting to tension the safety line 2 and wind it onto the drum 3. The drum 3 is selectively connected to a brake 8 through a speed sensitive clutch 9, the speed sensitive clutch 9 being arranged to allow free rotation of the drum 3 at low speeds of rotation and to engage the drum 3 to the brake 8 at high speeds of rotation above an activation speed. The brake 8 comprises a pair of opposed friction discs 8*a* and 8*b* loaded into contact with one another, one disc 8*a* being fixed to the casing 4 and the other disc 8*b* being arranged to rotate together with the drum 3 when the clutch 9 is engaged.

As shown in FIG. 2, in use the safety block 1 is attached to a fixed support structure above a region in which a user to be protected is working. The user wears a personal safety harness and attaches the end of the safety line 2 to the harness. The user can then move around the region below the safety block, including ascending and descending any structures within the region, as necessary. As the user moves, the tensioning and spooling mechanism 6 allows the drum 3 to rotate to pay out the safety line 2 as required to allow the movement and also causes the drum 3 to rotate to reel in the safety line 2 as required so that there is no slack in the safety line 2.

Normal movement of the user will result only in slow rotation of the drum 3 at speeds below the activation speed of the clutch 9. If the user falls, the safety line 2 will be pulled out and the drum 3 rotated at a rapidly accelerating speed until the speed of the drum 3 reaches the activation speed of the speed sensitive clutch 9. The speed sensitive clutch 8 will then engages the drum 3 with the brake 8. The energy of the user's fall is then absorbed by friction in the brake 8 until the fall is arrested, and rotation of the drum 3 is stopped.

However, there are a number of problems with known systems of this type.

Firstly, in order for the fall arrest system to safely and reliably stop a falling user, the braking force applied to the safety line by rotation of the drum against the friction brake must be precisely controlled. If the braking force is too low, the user will continue falling for an undesirably long distance before the fall is stopped. This results in an increased risk that the user will strike the ground or some other obstacle before their fall is stopped, so increasing the risk of injury or death. Further, as the distance fallen by the user gets larger the total amount of energy which must be absorbed and dissipated by the brake is increased, requiring a larger and more robust brake, for safety. If the braking force is too high, the force which is applied to the user by the safety block can become high enough to injure the user or cause damage or failure of the user's safety harness. The braking force applied to the drum by the brake in known systems is highly sensitive to the surface condition of the opposed faces of the friction disks and the degree of loading. As a result, it is difficult and complex to assemble the safety block so that the degree of loading of the friction disks is correctly set to provide the desired braking force. Further, there is a risk that the surface properties of the friction disks or the amount of loading between them will change over time, particularly in dirty working environments, so that regular inspection, checking and adjustment of the safety blocks is required to ensure safe and reliable operation.

In addition, in fall arrest systems it is generally required that after a fall arrest event has occurred, the system is checked and any components which may have suffered damage are replaced, in order to ensure future reliable operation of the system. This is particularly important in known safety block systems because the friction disks will suffer wear or damage when a fall arrest occurs, at least sufficient to affect the braking force, so that replacement of at least these parts of the brake is necessary after each fall arrest event.

However, known safety blocks do not inherently provide any indication that a fall arrest event has occurred, so that if a fall is not reported by the user the safety block or other parts of the safety system which have been exposed to fall arrest loads can be dangerously maintained in use without testing or replacement.

The present invention was made in an attempt to overcome these problems, at least in part.

In a first aspect, this invention provides a safety device suitable for use in a fall arrest system, and comprising: a body, attachment means for attaching the safety device to a support structure, a drum mounted for rotation relative to the body, a safety line wound on the drum, a speed sensitive clutch connected to the drum, and a linear energy absorber connecting the body to the attachment means, in which the speed sensitive clutch is adapted to respond to rotation of the drum relative to the body in a direction tending to unwind the safety line from the drum and above a predetermined speed by locking the drum against further rotation in said direction relative to the body, and the linear energy absorber is adapted to respond, when the speed sensitive clutch has locked the drum, to an applied load along the safety line greater than a threshold value by deploying and absorbing energy so that the attachment means moves away from the body.

The use of a linear energy absorber according to the invention to absorb the fall energy allows the braking force to be precisely controlled with a more simply and more easily set device. Further, the device is less prone to change over time, even in dirty environments, so that inspection, checking and adjustment is required less frequently.

Further, the deployment of the linear energy absorber results in a permanent vertical movement of the safety device away from the attachment means and supporting structure which is easily visible even from a distance, so that it is immediately apparent that a fall arrest event has occurred and that appropriate checking and replacement of parts should be carried out.

Preferred embodiments of the invention will now be described in detail, by way of example only, with reference to the accompanying figures, in which.

Figure 4:
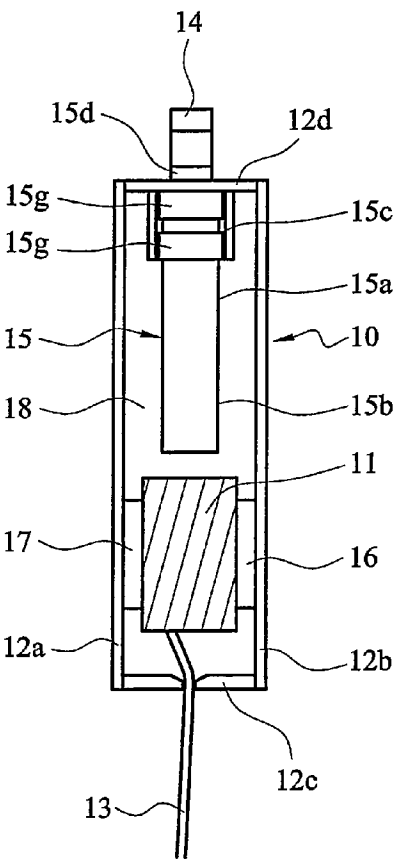
FIG. 4 shows a second view of the safety device of FIG. 3.
Figure 3:
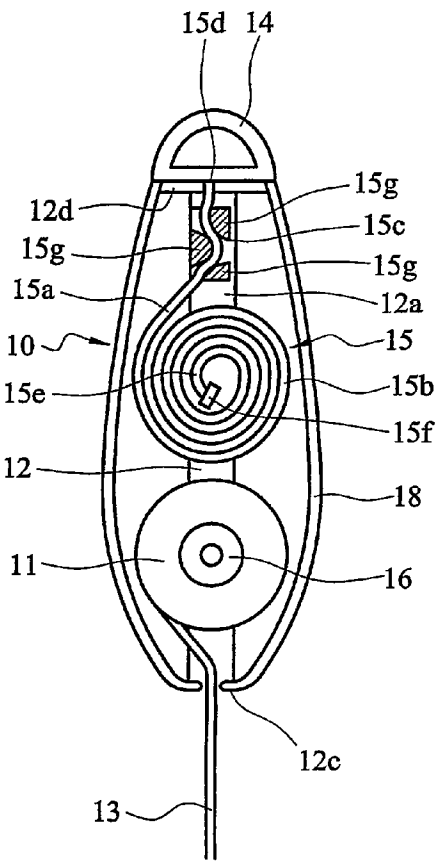
FIG. 3 shows a first view of a safety device according to a first embodiment of the invention.

A safety block 10 according to a first embodiment of the invention and suitable for use in a height safety system is shown in FIGS. 3 and 4.

The safety block 10 according to the first embodiment of the invention comprises a drum 11 mounted for rotation in a yoke 12. The yoke 12 comprises two parallel arms 12*a* and 12*b* connected together by lower and upper end pieces 12*c* and 12*d*, and the drum 11 is retained for rotation between the parallel arms 12*a* and 12*b*.

A safety line or cable 13 is wound around the drum 11 with a free end passing through a hole 18 in the lower end piece 12*c* of the yoke 12 and able to hang below the safety block 10. The safety line 13 has a connection means (not shown) suitable for connection to a personal safety harness of a user located at or near to it's free end.

As a safety precaution, it is preferred that the opposite end of the safety line 13 is secured to the drum 11 so that the safety line 13 cannot be released from the safety block 10 even when fully unwound.

In order to further protect a user, a further energy absorber may be provided as part of the connection means or the personal safety harness. An energy absorber of the rip out fabric type which absorbs energy by tearing stitches between multiple layers of fabric cloth or webbing as the layers are pulled apart is particularly suitable for use as such a further energy absorber.

The safety block 10 further comprises a linear energy absorber 15 mounted on the yoke 12 and an attachment eye 14 suitable for attaching the safety block to a fixed supporting structure at the upper end of the safety block 10. The attachment eye 14 is connected to the yoke 12 through the linear energy absorber 15 so that the linear energy absorber 15 is responsive to tensile loads between the attachment eye 14 and the yoke 12.

The linear energy absorber 15 has a predetermined deployment threshold load. That is, the linear energy absorber 15 does not respond to applied tensile loads below the deployment to threshold, but responds to applied tensile loads above the deployment threshold by deploying and increasing in length while resisting the applied tensile load and so absorbing energy.

Thus, the linear energy absorber 15 is arranged to connect the attachment eye 14 to the yoke 12 rigidly with a fixed distance between them while the tensile load between the yoke 12 and the attachment eye 14 is below the predetermined deployment threshold load of the linear energy absorber 15. If the tensile load between the attachment eye 14 and the yoke 12 exceeds this deployment load, the energy absorber 15 will respond by deploying and lengthening, so allowing the yoke 12 to move away from the attachment eye 14, and absorbing energy.

In principle, any type of linear energy absorber having suitable characteristics can be used. Preferably, the linear energy absorber is of the type which deploys and absorbs energy by plastic deformation of a part of the energy absorber or the rip out fabric type which absorbs energy by tearing stitches between multiple layers of fabric cloth or webbing as the layers are pulled apart. Most preferably, the linear energy absorber is of the type which deploys and absorbs energy by plastic deformation of a part of the energy absorber.

A particularly preferred type of linear energy absorber 15 is shown in the illustrated first embodiment. This linear energy absorber 15 is of the type which absorbs energy by passing a strip of plastically deformable material from a coil store through deforming means.

The linear energy absorber 15 comprises a stainless steel strip 15*a* connected at a first end 15*d* to the attachment eye 14. The other end 15*e* of the stainless steel strip 15*a* is formed into a coiled store 15*b* located between the arms 12*a* and 12*b* of the yoke 12 and has an end stop 15*f*. Deforming means 15*c* is attached to the upper end piece 12*d* of the yoke 12 and the stainless steel strip 15*a* passes through the deforming means 15*c* between the first end 15*d* and the coiled store 15*b*. The deforming means 15*c* preferably comprises a series of curved surfaces 15*g* in contact with the stainless steel strip 15*a* and arranged so that the steel strip 15*a* undergoes plastic deformation as it passes through the deforming means 15*c*. However, alternative arrangements, such as using pins or rollers to deform the steel strip, could be used.

The end stop 15*f* is provided as a safety precaution. If all of the stainless steel strip 15*a* is deployed so that the linear energy absorber 15 reaches the end of its deployment, the end stop 15*f* will stop the further deployment and so prevent the stainless steel strip 15*a* from being released from the deforming means 15*c*. As a result, the safety block 10 cannot become released from the fixed supporting structure.

The drum 11 is connected to the yoke 12 by a rewinding mechanism 16. When a length of the safety line 13 is payed out from the safety block 10 the rewinding mechanism 16 applies a small torque to the drum 11 relative to the yoke 12, in a direction which tends to rewind the safety line 13 back onto the drum 11. One preferred type of rewinding mechanism is a coiled spring of the clockspring type. Many suitable rewinding mechanisms of this and other types are well known, so this will not be described in detail herein.

The drum 11 is also connected to the yoke 12 by a speed sensitive clutch 17. The speed sensitive clutch 17 is arranged to allow the drum 11 to rotate freely in a direction paying out the safety line 13 from the drum 11 at rotational speeds below a threshold speed, but to respond to rotation speeds at or above the threshold speed in the paying out direction by locking the drum 11 to the yoke 12, preventing further rotation of the drum 11 in the direction paying out the safety line 13 from the drum 11.

There is no requirement for the speed sensitive clutch 17 to respond to rotation of the drum 11 in the direction winding the safety line 13 onto the drum 11.

Preferably the mechanism of the speed sensitive clutch 17 is arranged to emit an audible click as the drum 11 rotates in either direction in order to provide an audible indication of proper operation to the user.

Finally, the safety block 10 has an outer cover 18 to protect the other parts of the safety block 10. The drum 11 and linear energy absorber 15 are linked by the yoke 12 so that the load path between the safety line 13 and the attachment eye 14 is provided by the drum 11, speed sensitive clutch 17, yoke 12 and linear energy absorber 15. The outer cover 18 does not form part of the load path and only has a protective and aesthetic function. As a result, because the outer cover 18 is not load bearing it can be formed of a thin plastics material for light weight and cheapness.

In use, the safety block 10 is suspended from a fixed supporting structure (not shown) using the attachment eye 14 over a region in which a user will be working, a required length of safety line 13 is payed out from the drum 11 and the free end of the safety line 13 is attached to a personal safety harness of the user. These steps can be carried out in any convenient order, as required to set up the system.

The user can then move around the region as desired. The safety line 13 will be payed out from the drum 11 as required by the users movement, and the rewinding mechanism 16 will automatically rewind any excess safety line 13 back onto the drum 11 in normal use. The threshold speed of the speed sensitive clutch 17 is set high enough that it will not be reached during normal movement of the user so that the drum 11 can rotate freely and movement of the user is not interfered with.

If the user falls, the safety line 13 will be pulled out from the drum 11 at an increasing speed until the speed of rotation of the drum 11 reaches the threshold speed of the speed sensitive clutch 17. The speed sensitive clutch 17 will then lock the drum 11 to the yoke 12, stopping further rotation of the drum 11 in the paying out direction.

When the speed sensitive clutch 17 has locked the drum 11 to the yoke 12 the load along the safety line 13, in the event of a fall the load due to the weight and momentum of the falling user, is applied to the linear energy absorber 15. If this load is above the deployment load of the linear energy absorber 15, the linear energy absorber 15 will begin deployment and the stainless steel strip 15*a* will be deployed from the coil store 15*b* through the deforming means 15*c*. As a result, the yoke 12 and attached parts of the safety block 10 will move downwards away from the attachment eye 14 and the supporting structure. As the linear energy absorber 15 deploys, it absorbs energy and so slows and ultimately stops the falling user. When the user's fall has been arrested the user will remain suspended from the safety block 10 by the safety line 13 until the user is recovered, or is able to recover himself.

If the load along the safety line 13 is less than the deployment load of the linear energy absorber 15, the linear energy absorber will not deploy and the safety block will behave like a rigid body. This could occur, for example, if the user was to tug sharply on the safety line 13 to test the speed sensitive clutch 17.

The exact value of the deployment load at which the linear energy absorber 15 begins deployment can be selected as required in a particular use. The deployment load should be significantly greater than the anticipated weight of any user and their carried equipment in order to ensure that the linear energy absorber 15 properly arrests the fall of the user.

In practice, the length of the stainless steel strip 15*a* in the coil store 15*b* and the deployment load required to deploy the stainless steel strip 15*a* through the deforming means 15*c* should be selected so the total amount of energy which will be absorbed by the linear energy absorber 15 before the end of the stainless steel strip 15*a* is reached is significantly greater than the maximum amount of energy which will need to be absorbed in a worst case fall situation.

Preferably, the speed sensitive clutch 17 is arranged so that when the speed sensitive clutch 17 has locked the drum 11 to the yoke 12 it will then remain locked until the tension and safety block 13 is reduced to zero or a very low value. This ensures that after a fall has been arrested the drum 11 remains locked, so preventing further falls or uncontrolled descent. It is particularly preferred that the speed sensitive clutch 17 is arranged so that when the speed sensitive clutch 17 has locked the drum 11 to the yoke 12, it can only be unlocked by movement of the drum 11 in the direction winding the safety line 13 back onto the drum 11. This means that it is necessary to reduce the load on the safety block 10 to a sufficiently low level that the winding mechanism 16 can move the drum 11 back in the rewind direction in order to release the speed sensitive clutch 17 and unlock the drum 11.

Preferably all of the components of the safety block 10 forming part of the load path between the user and the supporting structure are designed to be able to support a load at least double the maximum deployment load of the linear energy absorber 15 when the linear energy absorber 15 is fully deployed and further deployment is prevented by the end stop 15*f*.

The deployment load of a linear energy absorber, particularly a linear energy absorber of the described plastic deformation type, is determined by the dimensions and the material properties of its components and not upon loads applied to the components, as in a friction disc type device. As a result, it is easier and simpler to assemble a safety device according to the present invention than the prior art devices using friction discs. Further, the loads required to plastically deform materials are based upon the bulk properties of the materials so that linear energy absorbers of this type are inherently less prone to changes in their properties due to contamination and other enviromental effects over time than the known frictional devices which are dependent on surface properties.

Further, the deployment of the linear energy absorber 15 results in a permanent vertical movement of the safety block 10 away from the attachment eye 14 and supporting structure which is easily visible even from a distance, so that it is immediately apparent that a fall arrest event has occurred and that appropriate checking and replacement of parts should be carried out.

Optionally, the linear energy absorber may be arranged to reveal a region having a colour contrasting to the casing of the safety block when deployment takes place to ensure that even a small amount of deployment is easily visible.

Accordingly, the present invention allows the problems encountered in the prior art to be overcome.

Figure 1:
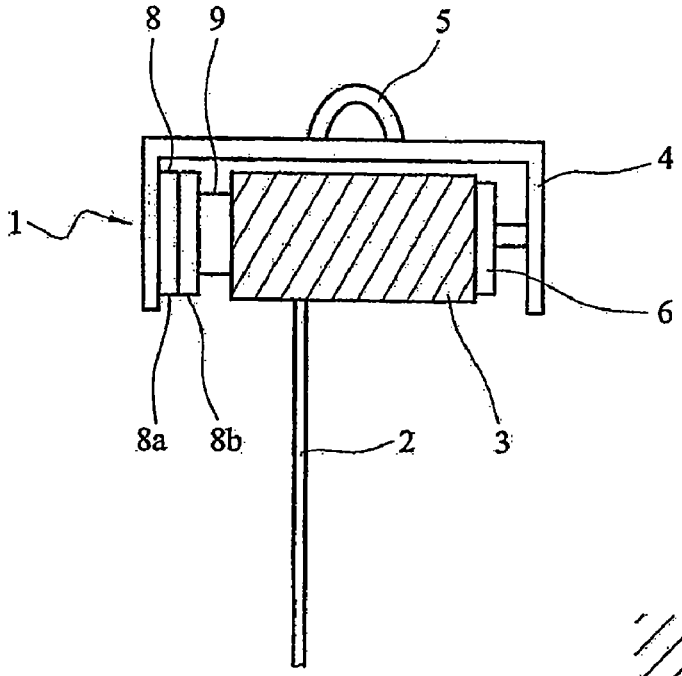
FIG. 1 Prior Art
FIG. 1 shows a known safety block.
Figure 2:
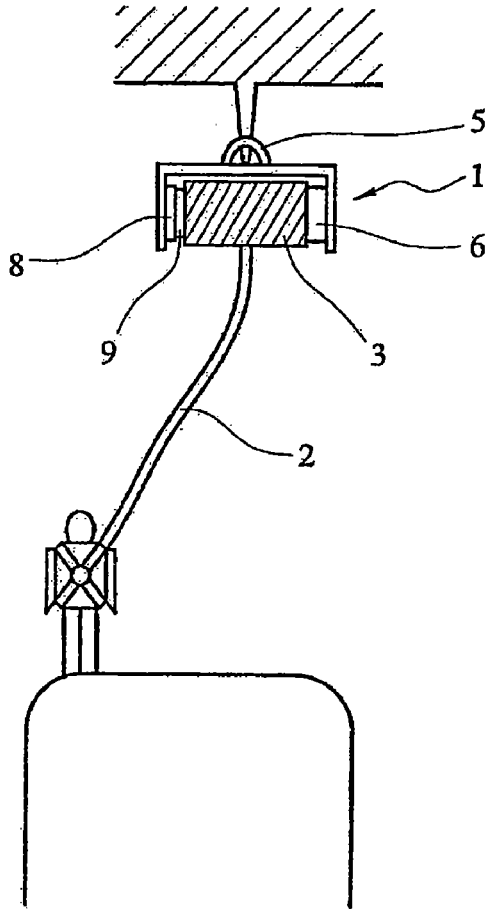
FIG. 2 Prior Art
FIG. 2 shows a height safety system including the safety block of FIG. 1.
Figure 5:
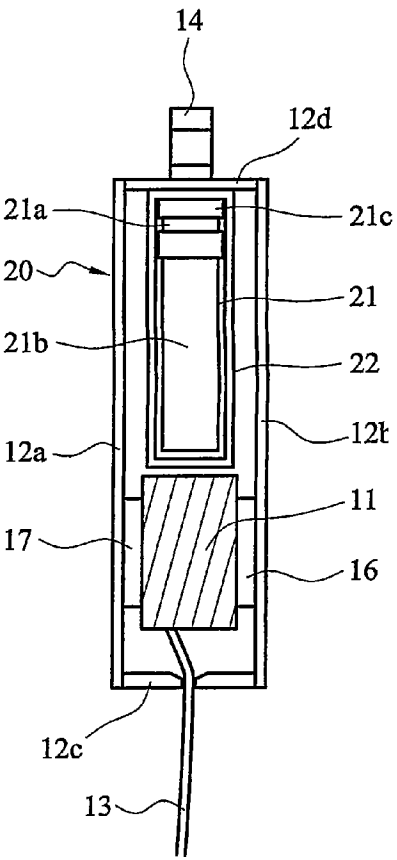
FIG. 5 shows a safety device according to a second embodiment of the invention.

A safety block 20 according to a second embodiment of the invention is shown in FIG. 5. The safety block 20 according to the second embodiment of the invention is generally similar to the safety block 10 of the first embodiment and has most parts the same. However, the safety block 20 according to the second embodiment has a linear energy absorber 21 comprising deforming means 21*c* mounted on a frame 22 and a stainless steel strip 21*a* arranged in a coil store 21*b* located within the frame 22. In the second embodiment, the linear energy absorber 21 is located within the yoke 12 between the arms 12*a* and 12*b* but the component parts of the linear energy absorber 21 are connected to the frame 22 of the linear energy absorber 21 and not directly to the yoke 12.

Thus, the safety block 20 according to the second embodiment has a modular structure with the linear energy absorber 21 formed as a separate module within and attached to frame 22. As a result, after a fall arrest event, the linear energy absorber 21 can be removed and replaced as a unit, allowing the safety block 20 to be quickly and easily returned to service.

Figure 7:
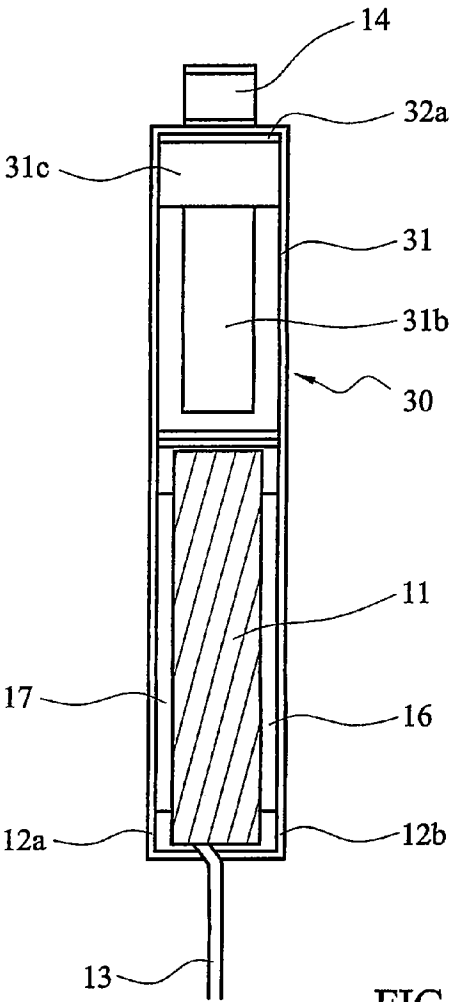
FIG. 7 shows a second view of the safety device of FIG. 6.
Figure 6:
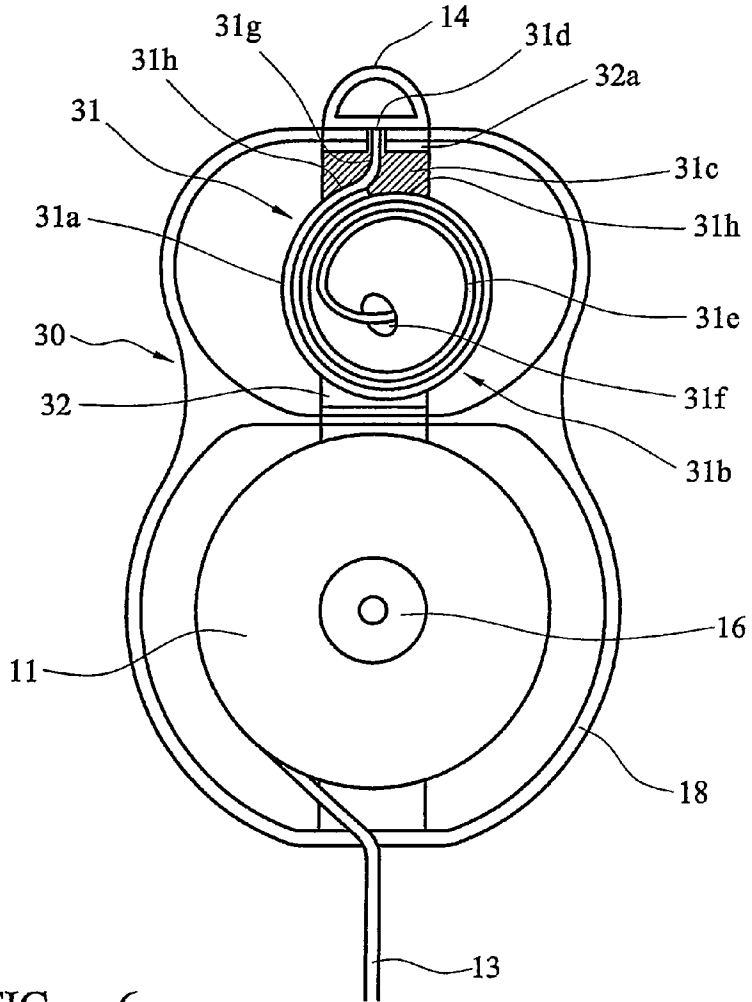
FIG. 6 shows a first view of a safety device according to a third embodiment of the invention.

A safety block according to a third embodiment of the invention is shown in FIGS. 6 and 7. The safety block 30 according to the third embodiment of the invention is generally similar to the safety blocks 10 and 20 of the first and second embodiments and has most parts the same.

The safety block 30 according to the third embodiment has a modular structure similar to the second embodiment with a linear energy absorber 31 formed as a separate module within and attached to a frame 32. In the same way as the second embodiment, after a fall arrest event, the linear energy absorber 31 can be removed and replaced as a unit, allowing the safety block 30 to be quickly and easily returned to service.

In the safety block 30, the linear energy absorber 31 is an alternative design to that used in the first and second embodiments, but is also of the type which absorbs energy by passing a strip of plastically deformable material from a coil store through deforming means.

The linear energy absorber 31 of the third embodiment comprises a stainless steel strip 31*a* connected at a first end 31*d* to the attachment eye 14. The other end 31*e* of the stainless steel strip 31*a* is formed into a coiled store located within the frame 32 and has an end stop 31*f*. Deforming means 31*c* is attached to an upper end piece 32*a* of the frame 32 and the stainless steel strip 31*a* passes through the deforming means 31*c* between the first end 31*d* and the coiled store 31*b*.

The deforming means 31*c* of the third embodiment comprises a curved slot 31*g* through which the stainless steel strip 31*a* passes and a curved bearing surface 31*h* shaped to receive the part of the stainless steel strip 31*a* forming the outer surface of the coiled store. The deforming means 31*c* is arranged so that coiled store of steel strip 31*a* is supported by the curved bearing surface 31*h* as it rotates and the steel strip 31*a* is deployed out of the coiled store and through the curved slot 31*g*. The steel strip 31*a* undergoes plastic deformation as it is deployed from the coiled store and passes through the slot 31*g*, so absorbing energy.

The end stop 31*f* is provided as a safety precaution, similarly to the first embodiment.

Preferably, the deforming means 31*c* is formed from a plastics material.

The linear energy absorber 31 of the third embodiment has the advantage of being particularly compact and mechanically simple.

In all of the embodiments of the present invention, it will usually be preferred to use a linear energy absorber of the constant force type which has an essentially constant deployment load required to continue deployment of the energy absorber across the full range of deployment. That is, in the illustrated embodiments, the deployment load required to deploy the stainless steel strip from the coil store through the deforming means is constant along the full length of the strip. This arrangement is usually preferred because if the linear energy absorber is arranged so that this constant deployment load is the maximum load which can be safely applied to the user during a fall arrest event, the amount of energy absorbed is maximised and the duration and length of fall of the user is minimised. However, energy absorbers having a variable deployment load could be used if preferred in particular applications.

The speed sensitive clutch is preferably a clutch of the rocking pawl type. However, a centrifugal clutch may also be used.

In the descriptions of the preferred embodiments set out above the use of a safety line or cable wound around the drum is referred to. This is not essential and other forms of elongate support such as a webbing strap could be used instead.

The above description refers to height safety systems for arresting a fall by a user. This is the most common application of a height safety system. However, the present invention can also be used in a height safety system to arrest falls by objects, for example, equipment being used or moved at height.

The embodiments discussed above are examples only and are not exhaustive. The skilled person will be able to envisage further alternatives within the scope of the present invention as defined by the attached claims.

The invention claimed is:

1. A safety device suitable for use in a fall arrest system, and comprising:

a body, attachment means for attaching the safety device to a support structure, a drum mounted for rotation relative to the body, a safety line wound on the drum, a speed sensitive clutch connected to the drum, and a linear energy absorber connecting the body to the attachment means, in which the speed sensitive clutch is adapted to respond to rotation of the drum relative to the body in a direction tending to unwind the safety line from the drum and above a predetermined speed by locking the drum against further rotation in said direction relative to the body, and the linear energy absorber is adapted to respond, when the speed sensitive clutch has locked the drum, to an applied load along the safety line greater than a threshold value by deploying and absorbing energy so that the attachment means moves away from the body.

2. A safety device according to claim 1, in which the linear energy absorber comprises a plastically deformable element which is plastically deformed to absorb energy when the linear energy absorber deploys.

3. A safety device according to claim 2, in which the plastically deformable element is an elongate member which is plastically deformed by passing through a deforming means when the linear energy absorber deploys.

4. A safety device according to claim 3, in which the elongate member is a strip or a round bar.

5. A safety device according to claim 3, in which the elongate member is stainless steel.

6. A safety device according to claim 1, in which the linear energy absorber comprises multiple layers of fabric linked by stitches, the layers of fabric being separated and the stitches torn out to absorb energy when the linear energy absorber deploys.

7. A safety device according to claim 1, in which the linear energy absorber is modular and can be removed and replaced from the safety device as a single element.

8. A safety device according to claim 1, in which the body includes a frame acting as a load path between the drum and the linear energy absorber, and the drum and linear energy absorber are located within the frame.

9. A safety device according to claim 1, in which the speed sensitive clutch is arranged so that when the drum has been locked the load on the safety line must be reduced to zero to unlock the drum.

10. A safety device according to claim 9, in which the speed sensitive clutch is arranged so that when the drum has been locked the drum must be rotated by the rewinding means in a direction tending to wind the safety line onto the drum in order to unlock the drum.

11. A safety device according to claim 1, and further comprising a rewinding means adapted to bias the drum to rotate relative to the body in a direction tending to wind the safety line onto the drum.

* * * * *

UNITED STATES PATENT AND TRADEMARK OFFICE
Certificate

Patent No. 7,744,063 B2 Patented: June 29, 2010

ON petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Karl Jones, Wiltshire (GB); and Paul Illick, Spring, TX (US).

Signed and Sealed this Twelfth Day of July 2011.

MICHAEL R. MANSEN
*Supervisory Patent Examiner*
Art Unit 3654
Tecnology Center 3600